United States Patent [19]

Roth

[11] 4,105,140

[45] Aug. 8, 1978

[54] WALL-MOUNTING UNIT ARRANGEMENT FOR LOCATING ABOVE A WASH BASIN AND DEFINING A SHELF WHERE OBJECTS MAY BE DEPOSITED

[76] Inventor: Eckart Roth, Rosenstrasse 41, 7272 Altensteig, Fed. Rep. of Germany

[21] Appl. No.: 754,999

[22] Filed: Dec. 28, 1976

[51] Int. Cl.[2] ..... B67D 5/60

[52] U.S. Cl. ..... 222/131; 222/182; 222/192

[58] Field of Search ..... 222/182, 192, 93, 131, 222/113

[56] References Cited

U.S. PATENT DOCUMENTS

| | | | |
|---|---|---|---|
| 1,690,699 | 6/1928 | Peterson | 222/131 |
| 3,055,548 | 9/1962 | Allegri | 221/131 |
| 3,130,873 | 4/1964 | Kutz, Jr. | 222/182 X |
| 3,142,415 | 7/1964 | Louchheim | 222/113 X |

*Primary Examiner*—Allen N. Knowles

*Attorney, Agent, or Firm*—Watson, Cole, Grindle & Watson

[57] ABSTRACT

A wall-mounting unit includes a horizontally disposable shelf and a number of dispensers positioned below the shelf. The dispensers are each covered in front with a plate which has openings therein for outlets and operative levers to pass therethrough, and is shaped so as to have a recess towards the wall-contacting side of the unit.

9 Claims, 6 Drawing Figures

WALL-MOUNTING UNIT ARRANGEMENT FOR LOCATING ABOVE A WASH BASIN AND DEFINING A SHELF WHERE OBJECTS MAY BE DEPOSITED

BACKGROUND OF THE INVENTION

The present invention is directed to a wall-mounting unit which is arranged to be located, for example, above a wash basin, and which comprises a shelf where objects may be deposited, and a number of attachments, which may include dispensers of various media such as soap, handcream, or disinfectant.

It is an object of the invention to provide a mounting unit of the type referred to above, which serves at the same time as a storage shelf and as a mounting strip for various devices, which has an attractive appearance, design which has a compact which is the unit takes up less space than other units offering the same possibilities; which has a design which is moreover variable in many ways, and which is cheap and simple to assemble.

SUMMARY OF THE INVENTION

According to the invention there is provided a wall-mounting unit arranged to be located, for example, above a wash-hand basin, and which comprises a member which defines a substantially horizontally disposed element in use to support objects thereon and defines therebelow a storage compartment wherein at least one attachment, for example a dispenser of media in the form of soap, hand cream or disinfectant, may be located, masking means being provided for at least that front part of the unit extending between the member and the location for the attachment.

A particularly favorable design makes room for the hands so that they may receive the soap or other medium without touching or soiling the unit in an unhygienic manner.

DESCRIPTION OF THE DRAWINGS

Embodiments of the invention will now be described, by way of example only, with reference to the accompanying drawings.

In the drawings.

DESCRIPTION OF THE PREFERRED EMBODIMENTS

Figure 1:
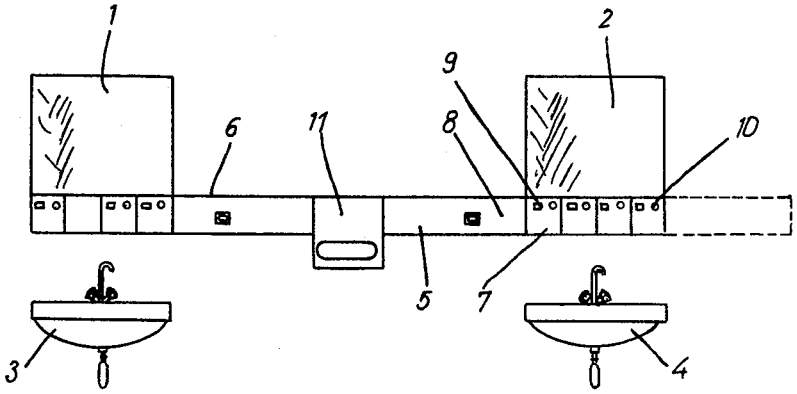
FIG. 1 shows a wall-mounting unit fixed to a wall in a front view.

FIG. 1 shows the wall of a washroom. Underneath the mirrors 1, 2 are the two wash basins 3, 4. A continuous wall-mounted unit 5 extends along the wall between the mirrors and the wash basins, which combines the functions of a storage shelf with those of a mounting member for attachments, the essentially horizontal upper surface 6 serving for the depositing of any objects, and the mounting member supporting the attachments being provided with a front section which partly conceals the latter, forming a storage compartment in which the attachments are accommodated in a suspended fashion, the upper surface of this compartment being constituted by the underside of the storage surface 6.

The masking member is divided into several sections, for example into parts 7 and 8, whereby a dispenser for soap, hand-cream, a disinfectant, bath lotion, detergents or the like, may be located behind the masking section 7, the dispenser having an outward projecting operating handle 9 and a discharge opening 10 for the dispensed medium. By pressing the handle 9 downwardly, the chosen medium passes through the discharge opening onto the hands held underneath the opening. The masking section 8 at the side of this section 7 does not conceal attachments but an empty compartment serving for the storage of any goods such as cosmetics, spare bottles used for the topping up of the dispensers, or other toiletries. The symmetrically designed wall mounting unit 5 finally comprises in its middle section a dispenser for paper hand-towels, the delivery slot being either at the bottom or in the front wall of the dispenser.

The storage compartment of the wall mounting unit shown in FIG. 1 is completely covered by masking strips, each being detachably assembled with the storage shelf so that access is given into the compartment as and when required. A unit of this type not only is pleasing to the eye, it is also extremely hygienic. The dimensions of the individual masking elements may conveniently correspond to those of the wall tiles.

Masking elements covering a gap between two attachments such as, say, the space corresponding to section 8, may support sockets or electric switches, for example a lighting switch, or they may be provided with ventilation slots for fresh-and waste-air ducts opening into the storage chamber.

The range of application of this invention is, however, not limited to toilets, washrooms, and the like or certain rooms in hospitals such as rooms for medical examinations or rooms attached to operating theaters. The unit according to the invention might equally find a useful application in restaurants or bars, in which case the dispensers would be filled with drinks or beakers.

Moreover, the storage shelves, the masking units or rather their individual sections, will be cut to the required lengths from standard sections supplied by the meter. In this manner it is feasible to install wall mounting units of any desired length without having to incur additional expense. This is indicated, in FIG. 1, in the broken line section.

While it is not necessary that the storage compartment be covered completely with masking elements, it is advisable for esthetic reasons, to adapt the design of any attachments which are left unmasked, to the design of the masking sections used, and to ensure that no dirt collecting corners are created.

Figure 2:
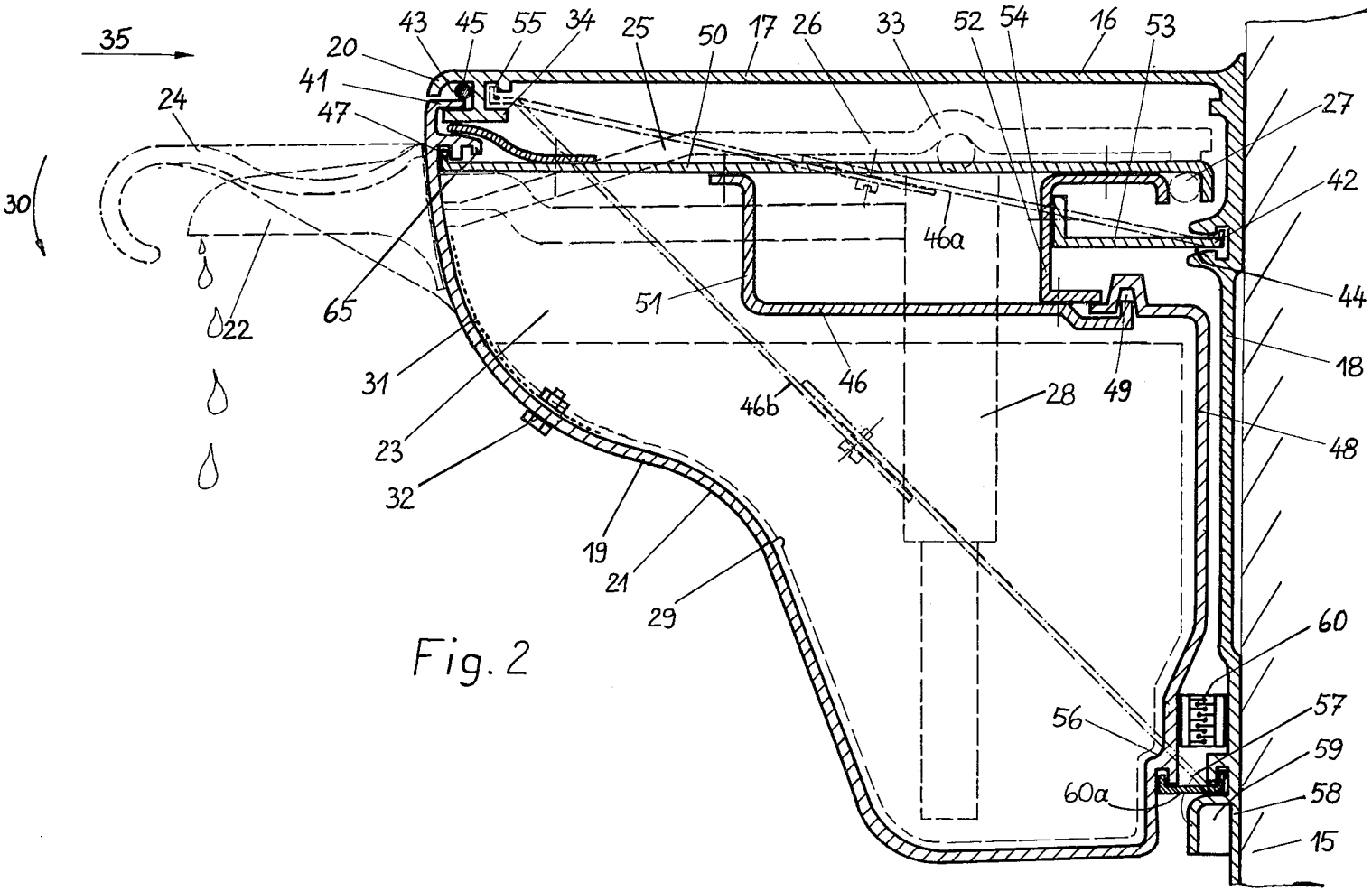
FIG. 2 shows a cross-section through a first embodiment of the invention, in a schematic representation.

To examine the details of the wall mounting unit according to the invention, one has to analyse FIG. 2 which depicts the design of the first embodiment in cross-section. FIG. 2 shows the section of a wall mounting unit where the dispenser is accommodated. A storage shelf 16 is fixed to the wall 15. The upper surface 17 of the shelf 16 is essentially horizontal but slopes slightly downwards towards the wall 15, to avoid the danger of round objects rolling off the shelf surface 17. A vertical mounting element 18, fixed to the wall 15, extends downwards from the shelf surface 17, approximately at right angles. The masking element 19 which is detachably assembled with the shelf 16 extends, as seen in cross-section, from the front edge 20 of the shelf surface 17, which is remote from the wall 15, in a downward direction which is essentially slanting towards the wall 15. This masking element 19 comprises approximately at mid-height, a zone 21 which is recessed towards the wall. The outlet 22 of the dispenser in the storage compartment 23, which is shown in the figure in broken lines, projects through the masking element 19 or rather the component constituted by it, at a position above the recessed portion. It is because of this recess 21 in the masking element 19, that the danger of dirt or germs being spread by the users' hands, positioned underneath the dispenser outlet 22 in order to receive the medium such as soap, is averted.

The dispenser comprises moreover an operating lever 24 which, relative to the dispenser outlet 22, is staggered, and projects, like the outlet itself, towards the front. The part of the lever 24 inside the storage compartment 23 has a cranked section 25 and adjacent to it a horizontal section 26, hinged at point 27 in a manner which is not shown in the drawing. The operating lever acts on a pump 28 which is likewise presented in the drawing in broken lines, and is immersed into a tank 29. Thus, when swivelling the lever 24 in the direction indicated by the arrow 30, the medium in the tank 29 is enabled to reach the dispenser outlet 22. Needless to say, the outlet could also be located in the underside of the masking section. Finally, the masking section 19 comprises a vertical slot accommodating the operating lever 24, the region of the slot being provided with a grid or grooves 31. These grooves 31 serve for the anchorage of an adjustable stopping element having the form of a set-screw 32 which determines the end positions of the operating lever 24, thus controlling the stroke of the pump 28. As an alternative for a pump and a valve, the underside may be provided with a drain cock operated under excess pressure conditions.

Figure 3:
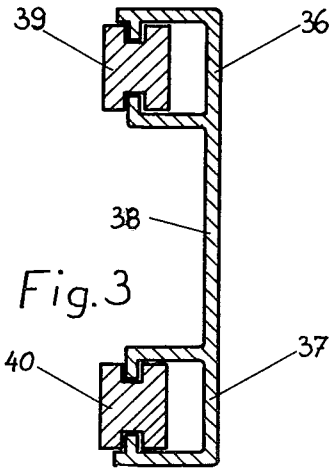
FIG. 3 and FIG. 4 show details of the arrangement according to FIG. 2.

The masking section 19 is designed as a sliding unit which accommodates the media-dispenser. With the embodiment according to FIG. 2, it is therefore feasible to divide the entire storage space into drawer-like sliding units each accommodating an attachment or any other object, the front of each compartment being formed by individual masking sections. With this arrangement the tank 29 can be replenished without having to unscrew any component, nor is it necessary to remove parts in a cumbersome way or take any objects off the shelf surface 17. All that is required when refilling the tank 29 is to pull the drawer out. The drawer is prevented from dropping out by accident, by a stopping member 33 projecting from the swivelling plane of the operating lever 24 and engaging with a stop 34; when the lever 24 is operated the stopping member 33 disengages the stop 34, so that the drawer may be taken out intentionally, say for cleaning purposes. The runners of the drawer are located immediately beneath the shelf surface 17 as shown in FIG. 3. FIG. 3, which depicts the drawer-control as seen in the direction of the arrow 35 in FIG. 2, shows that it comprises two thin groove elements 36, 37, which are interconnected through a web 38 and fixed to the shelf. The two twin groove elements 36, 37 engage with correspondingly designed members 39, 40 on the drawer. In this manner it has been ensured that the drawers move absolutely accurately and parallel to each other, whereby the installation height of the drawer control is so small that it is almost unnoticeable from the outside of the assembly. The direction of the drawer control is moreover adjustable by means of set-screws.

The drawers are provided with a front- and/or rear lug 41/42 engaging with a corresponding groove 43/44 to facilitate the safe fitting and reliable holding of the fitted units. The front fitting groove 43 is located in the front part 20 of the shelf 17, while the rear groove 44 is accommodated in the fixing unit 18 of the shelf. The front groove 43 is moreover provided with a sealing section 45 against which the front lug 41 rests when the drawer is in its inserted state, said seal enabling the drawer to be pushed in smoothly, and avoid any rattling noise.

In the illustrated embodiment, the rear lug 42 is located at a stiffening link 46 which reinforces the drawer and consequently the shelf, the link engaging with grooves 47 and 49 which are located, on the one hand at the upper, front edge of the masking section 19, and on the other hand at the rear wall 48 of the masking section 19, which is adjacent to the wall 15, extending upwards. The stiffening link 46 consists of two sections, the front section being composed of parts 50, 51, 52 which are firmly interconnected, and the rear section 53 being the part which comprises the rear lug 42. The two sections are vertically adjustable by the aid of a slot connection 54. This means that also the two guide lug 41, 42, are vertically adjustable relative to each other, this facilitating their correct setting.

Obviously it is feasible to include more than one stiffening link, depending on the required stability of the system. Regarded in the longitudinal direction of the shelf unit, these stiffeners will always be located outside the pump range and they will not interfere with the charging hole of the tank. Additional means of stiffening could be constituted by cross beams **46*a*, 46*b*, hooked in at any chosen positions of the system seen in the longitudinal direction. The cross beams 46*a* extend from a front tie groove 55 towards the rear, being inclined downwards towards the rear fitting groove 44 while the cross beams 46*b* may extend from the front tie groove 55 to a tie groove 56 at the bottom rear end. The total design is stable to an extent which enables the cross section of the unit 16 to be relatively small, and the fixing unit 18 to be relatively short. In addition to this there is no danger of drawers being deformed when drawn out, the mechanical strength being great enough even with pneumatically operated media-dispensers. The length of the cross beams 46*a* and 46*b* may moreover be variable, because they may consist for example of two longitudinally adjustable beam elements as indicated in FIG. 2**, in a schematic manner.

The lower edge zone 57 of the fixing unit 18 is staggered towards the front. The resulting gap enables a wall panelling 58 to be sandwiched in by the aid of a foam section 59, which may serve as a masking element covering say dowel holes or the like which deface the wall surface 15. It is similarly possible to cover any bolting recesses if present. The lower part of the fixing unit 18 may moreover comprise a holding connection 60, for example, a "sticky" seal as an additional means of fastening it to the masking element. The seal is additionally tightened by means of a clamp **60*a*. Finally, a funnel shaped projection 65 which facilitates the topping of the tank 29, is provided as an integral member, at the upper edge of the masking section 19**.

Figure 4:
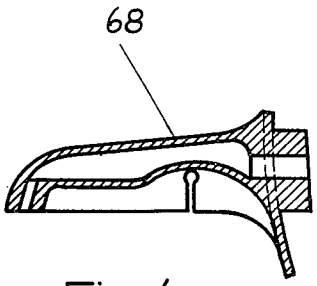

The projecting part comprising the dispenser outlet 22, which is shown in detail in FIG. 4, consists of a detachable or rather hinged, discharge nipple 68. Being easily disconnected the nipple detatches itself when it is unintentionally hit, thus reducing the danger of damage. Apart from this the packing of the unit is facilitated by the disconnectability of the outlet nipple.

Finally, it seems noteworthy that the shelf 16 and the masking section 19 are extruded profiles made for example of a plastic material or of metal, and that the front edge of the shelf surface 17 is rounded off downwards, while the edge of this surface 17, which is adjacent to the wall 15 is rounded upwards; the shelf is therefore free from a dangerously sharp front edge and its connection with the wall is reliably smooth.

Figure 5:
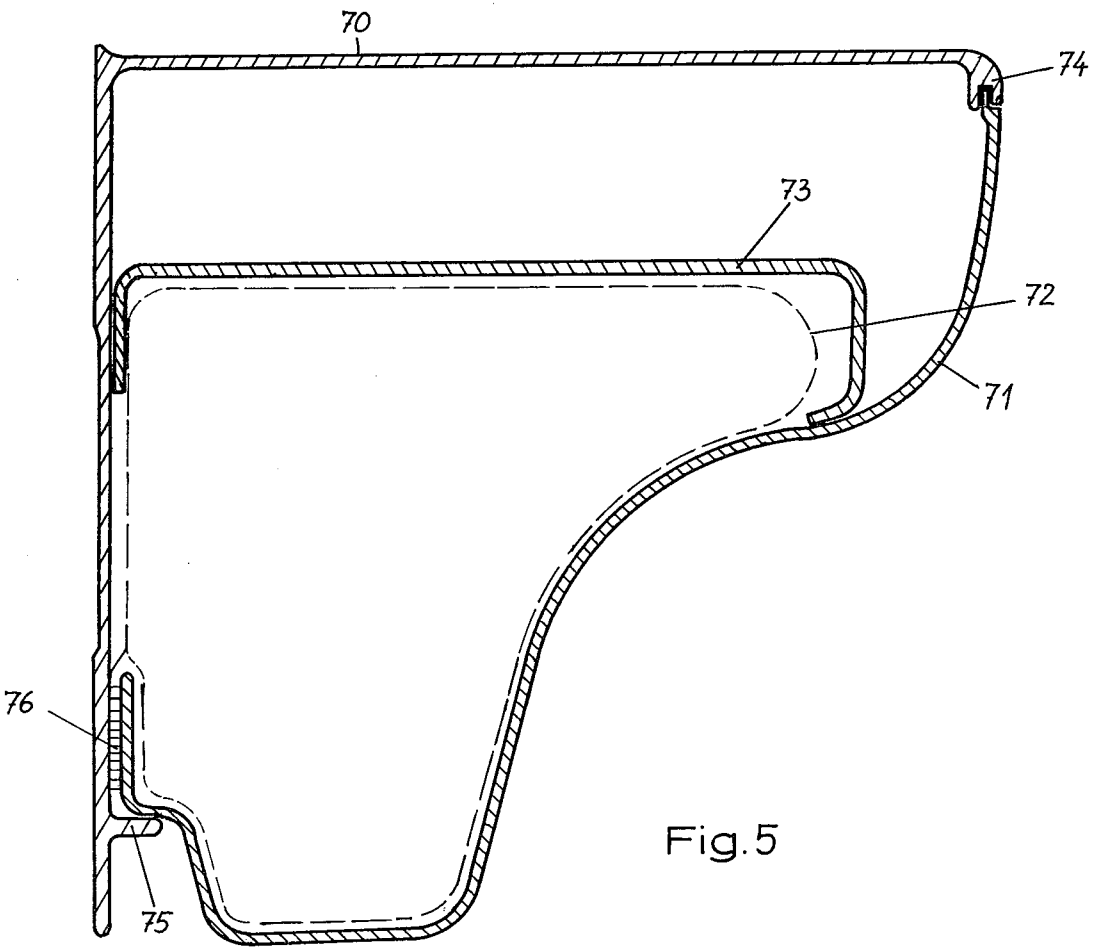
FIG. 5 shows a cross-section through a second embodiment of the invention, in a schematic representation.

FIG. 5 shows another embodiment in the form of a shelving unit 70 with a masking section 71. In this case, the masking section 71 is connected with the tank 72 through a link 73, so that a single unit is created. This unit, however, is not designed in the form of a drawer, but it is connected with the storage shelf through a locking connection 74, 75. There is no need for topping the tank. The latter is exchanged when its contents are used up. As above, this embodiment too is provided with an additional adhesive connection 76.

Figure 6:
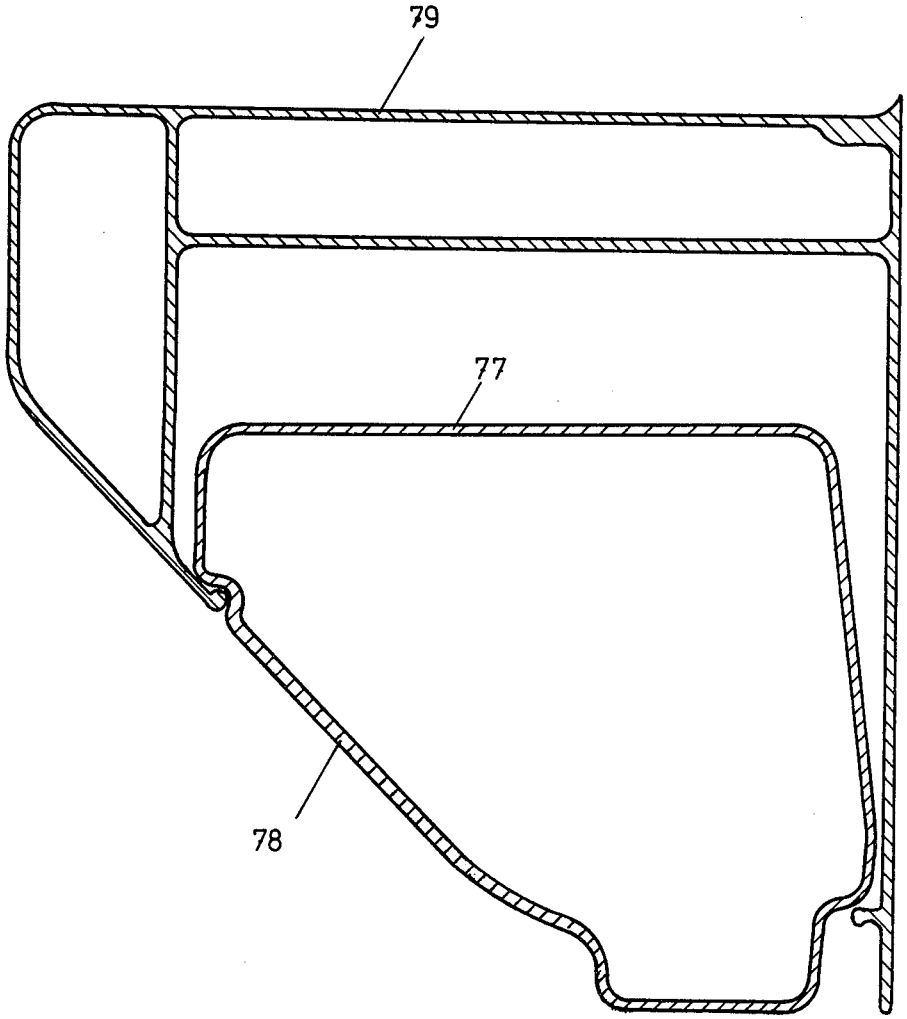
FIG. 6 shows a cross-section through a third embodiment of the invention, again schematically presented.

The embodiment according to FIG. 6 includes a tank 77 which is not concealed by a masking section. Instead, the form of the front surface 78 of the tank is adapted to the form of the masking section, and it is fully visible from the outside.

It seems evident that masking sections may be inserted between the individual dispensers. The tank 77 which may comprise a built-in pump, is directly suspended from the shelf 79. It is therefore not difficult to replace an empty tank by a full tank. In addition to this, the head in the tank can be read off at any time.

So far, only the use of extruded profiles has been discussed. Their lateral end fittings are cap shaped elements which act as additional stiffeners and thus make it possible to use thin-walled sections. It is for example moreover feasible to use — with the most widely installed forms — injection moulded parts or die-cast members, which may be considered advisable for economical reasons. This means that standardised sections are used which, again, may consist of metal or of a plastic material.

It is easy to realise that the embodiments described above could be modified in order to manufacture integral units which combine the shelving space and the masking elements into one single piece. In this case, the storage compartments could be accessible through hinged doors or recesses and it would therefore not be necessary to withdraw a drawer or the like in order to fill up a tank. Components manufactured by the injection moulding process may of course comprise any number of compartments, each associated with a refill flap.

In a further embodiment of the invention, intermediate wall sections could be used which are similar to the end caps and are inserted between the attachments or rather between the masking sections, to increase the stiffness of the unit and create an attractive surface by an optically pleasing division. These intermediate wall sections could for example be designed as drawers or comprise embossed portions which serve as stops.

I claim:

1. An installation combination for fastening to a wall, for example, above a wash basin, and comprising (1) a shelf with an essentially horizontally running shelf surface for the depositing thereon of objects and (2) additional devices, for example, medium dispensers in the form of soap, skin lotion or disinfectant dispensers which are arranged in a longitudinal direction of the shelf whereby the lower side of the shelf surface limits the top of a space receiving the additional devices, a space which is covered, at least towards the outside, within the area of the additional devices by means of a plate which can be removed from the shelf; characterized by the fact that the shelf represents, over its entire length, the cut-off length from a shelf section available in any number of meters, that the additional devices are suspended from the shelf, and that each additional device is covered by a special plate section which, viewed in its cross-section and proceeding from the front area of the shelf surface away from the wall to which the installation combination may be attached, runs towards the bottom and towards the wall by forming a recess towards the wall whereby, with a dispensing section covering a medium dispenser as an additional device, the spout of the medium dispenser penetrates through an opening in the plate section above the recess.

2. Installation combination according to claim 1, characterized by the fact that each plate section is a length cut off from a sectional shelf material kept on stock in any number of meters.

3. Installation combination according to claim 1 characterized by the fact that each additional device is assembled to form a unit with the respective plate section which is guided at the shelf like a drawer.

4. An installation according to claim 1 wherein each of the plate sections, which conceals an attachment in the form of a dispenser, is provided with a vertical slot to accommodate a lever for the dispenser control, and a vertically adjustable stopping member is provided for the lever, so as to control the stroke of a dispenser pump which is actuated by the lever, means being provided alongside the slot so that the stopping member can be retained in its set position.

5. An installation according to claim 4, wherein each dispenser is placed in a drawer and wherein the drawers are provided with a front- and a rear guide lug, which, in an inserted condition, engage or engages with a corresponding guide-groove connected with said member, the two lugs being vertically adjustable relative to each other and at least one of the lugs being associated with a packing section on said member, resting against the latter in the inserted condition.

6. An installation according to claim 5, wherein the drawers are provided with stiffening links which engage with link grooves on said member and which define integral units with the masking sections, the links engaging at one side with an upper front edge of the respective masking section, and at the other side with a rear wall section of the masking section, which is adjacent to the wall and extends upwardly said stiffening members being defined by two parts, a rear part including the rear guide-lug being vertically adjustable relative to a front part.

7. An installation according to claim 1, wherein said shelf comprises a vertical mounting element which extends in use, substantially perpendicularly from the horizontally disposed shelf surface and may be fixed to a wall, a bottom edge part of the vertical mounting element being displaced forwardly thereof to retain in position wall panelling elements which extend downwardly, the vertical mounting element being additionally fixed to the plate means by a clamping element.

8. An installation according to claim 1, wherein a tank of a dispenser is so shaped as to fit into the plate means, a funnel-nose being located on the plate means at a location above a head-charging nozzle of the tank.

9. An installation according to claim 1, wherein said shelf and the plate means consist of extruded sections which are made from a plastic material or from metal, and which are provided with end caps serving as stiffening members.

* * * * *